US006464020B1

(12) United States Patent
Wills

(10) Patent No.: US 6,464,020 B1
(45) Date of Patent: Oct. 15, 2002

(54) APPARATUS AND METHOD TO DRILL AND LIFT CORE-DRILLED SPECIMENS FROM AN AGGREGATE MEDIUM

(75) Inventor: Ronnie W. Wills, Katy, TX (US)

(73) Assignee: Aggregate Technologies, Houston, TX (US)

( * ) Notice: Subject to any disclaimer, the term of this patent is extended or adjusted under 35 U.S.C. 154(b) by 35 days.

(21) Appl. No.: 09/650,804

(22) Filed: Aug. 30, 2000

(51) Int. Cl.[7] ..... E21B 7/26; E21B 11/00

(52) U.S. Cl. ..... 175/20; 175/122; 175/170; 175/203; 173/31

(58) Field of Search ..... 175/20, 122, 170, 175/203; 173/31

(56) References Cited

U.S. PATENT DOCUMENTS 3,722,602 A * 3/1973 Rogers
5,004,055 A * 4/1991 Poritt et al.
5,058,688 A * 10/1991 Scott et al.
5,076,392 A * 12/1991 Koenig
6,315,059 B1 * 11/2001 Geldean

* cited by examiner

*Primary Examiner*—Roger Schoeppel
(74) *Attorney, Agent, or Firm*—Conley, Rose & Tayon, P.C.; Jonathan M. Harris

(57) ABSTRACT

An single apparatus to drill and lift core specimens from an aggregate field includes a frame structure that can be deployed to a workface and is adapted to hydraulically deploy a rotating core drilling bit upon that workface to cut a core specimen from the substrate. The hydraulic deployment of the drill bit is self aligning and does not require complex alignment steps to ensure the maximum cutting efficiency and lifetime of the bit. The same apparatus that can be used to drive and deploy the drill bit can also be adapted to receive and lift the as-cut core specimen from the newly created hole in the substrate. Once lifted, the received specimen can be positioned out of the work area so that work within the newly created circular hole can progress.

26 Claims, 4 Drawing Sheets

APPARATUS AND METHOD TO DRILL AND LIFT CORE-DRILLED SPECIMENS FROM AN AGGREGATE MEDIUM

CROSS-REFERENCE TO RELATED APPLICATIONS

Not Applicable.

TECHNICAL FIELD OF THE INVENTION

The present invention relates generally to a device to drill hardened aggregate materials. More particularly, the invention relates to an apparatus to cut and pull generally cylindrical "core" sections out of an aggregate material substrate. More particularly still, the present invention relates to an apparatus to cut and pull generally cylindrical forms from steel reinforced concrete, leaving a generally cylindrical hole where a continuous pour of concrete once existed.

BACKGROUND OF THE INVENTION

Concrete is widely used as a building material in various types of construction projects because of its material advantages in the properties of hardness, durability and compressive strength. Concrete is considered to be in the class of "Aggregate" materials because it typically comprises an aggregation of limestone, sand, and other materials held together by a cement binder. The ability of concrete to withstand various environments enables it to be used in both subterranean and above-ground applications. Examples of subterranean use of concrete include building foundations, tunnels, and underground fluid, gas, and power transmission conduits. Above-ground uses of concrete can include structural walls, bridges, and roadways. Interestingly enough, many roadways and bridges use concrete for both above and below ground applications, often simultaneously withstanding the environments of water, extreme heat, and extreme cold.

Although concrete is highly resilient to compressive forces, it can be damaged easily if exposed to tensile or bending loads without reinforcement. Concrete strengthening is typically performed through the deployment of generally cylindrical steel reinforcement bars, commonly referred to in the construction industry as "re-bars." Although reinforcement materials are available in a wide assortment of forms and composition, plain carbon steel re-bars are the most widely used because of their broad availability and low cost of manufacture. Typically, before a concrete form is to be poured, the re-bars are arranged within the form in a pattern and at a spacing determined by the design and geometry of the object to be poured. In the example of a flat "slab" of concrete, re-bars are usually laid out in a grid-like pattern at a depth often near the middle of the slab thickness. Once the re-bars are arranged, concrete is poured within the rest of the form and left to harden. The resulting material is known as a "composite" because two dissimilar materials are combined with one another to form a new composition with unique physical properties.

Concrete is used frequently because its initial liquid form is easy to deploy and is extremely durable and hard when cured. One major drawback to concrete is that it is very difficult to modify effectively once cured. Often, it is desired to have access to areas that may be covered by cured concrete, especially in regards to roadways or foundations. For example, if a project requires the repair or installation of sewer lines, it may be necessary to unearth or otherwise dismantle portions of streets and highways will need to be unearthed or otherwise dismantled to allow the work to continue. Traditionally, workers with heavy impact tools break up the surrounding area and then clear a path for the work to progress. Although effective, this method often affects an area of the workpiece that is much larger than required. Because a large area is "broken-up," a repair operation must be performed to replace the concrete that was sacrificed in order to create the desired access way. Furthermore, the "break-up" method for modifying concrete installations is highly time consuming and is a destructive process. Concrete that is broken up to remove is not easily replaceable once the work is completed and typically requires a new pour of concrete to patch the area affected.

Recently, techniques such as concrete "coring" and "sawing" have come into light that greatly reduce the amount of the "affected" area surrounding a concrete worksite. Sawing typically involves the use of a large circular saw to saw completely through the thickness of the concrete and re-bar to cut out the desired area. The benefits of sawing are that precise cuts can be made thus enabling the affected area for polygonal shaped cutouts to be minimized. Once the cutout is sawed, a crane can be brought in to lift and remove the cutout as one solid piece. After the work is performed, the piece can be replaced by the crane and re-secured with sealant or concrete patching. The main advantage of concrete sawing of this type is that the affected work area is minimized. Additionally, the affected area can be quickly and inexpensively replaced and repaired following service to the exposed earth.

The primary drawback of the disc-sawing method is that it is limited to polygonal cutouts and therefore does not permit generally circular holes to be cut. For example, if a circular cutout for the installation of a pipe is desired, a larger polygonal (usually rectangular) cutout must be removed. Once the area is cutout, the pipe is installed in place and the annulus between the cutout and pipe must be re-poured and reinforced. Furthermore, whereas traditional "breaking" operations required only a few workers with jackhammers and material removal equipment, concrete sawing requires more costly cranes and sawing equipment to be maintained on site. Other examples of items that would require such circular cutouts include, but are not limited to, manholes, junction boxes, circular shaped utility stations, and conduit installations.

To make circular cutouts in aggregate materials, a process known as core drilling is often performed. Traditional core drilling applications include the delivery, assembly, installation, and alignment of a drill rig. The drill rig typically takes the form of a cantilevered frame structure that rotates a coring bit with a drive motor. Although they are typically much larger, coring bits closely resemble the "hole saws" used by carpenters as they generally take the form of cylindrical barrels with cutting teeth disposed about the circumference of one end of the barrel. The structure of a core drilling rig typically takes the form of a cantilevered frame that suspends and drives the bit from one side.

A significant drawback to a rig of this type is that it must undergo significant manual setup steps to ensure that the apparatus is properly leveled and the axis of the hole is normal to the plane of the workface. Proper alignment ensures that the cantilevered load is distributed substantially evenly across the cutting surfaces of the drill bit to maximize bit life. Whilst in operation, downward force is applied to the bit manually by an operator that operates a load handle from one side of the rig. The operator typically pulls the load handle in a downward direction to force the drill bit down, in a manner similar to the operation of a drill press. As the bit is rotated and loaded, the core drill cuts through both the aggregate material and any reinforcement materials that may be present. In concrete drilling, it is not uncommon for the bit to cut through several inches of concrete, followed by a few inches of composite concrete and steel, and finish through several more inches of concrete. This type of cutting condition places a severe amount of stress and wear upon the teeth of the drill bit, thus making proper setup and alignment paramount.

Because a typical core drilling apparatus must be manually aligned and leveled, it is often difficult to ensure that it begins and stays in proper alignment. An inherent flaw in the design of the traditional drilling rig is that the cantilevered construction allows the bit to "walk" or become further misaligned as bit penetration progresses downward. Once the bit walks out of alignment, the cutting teeth at the end of the bit are no longer as able to be as resilient to wear as they were at the beginning of the operation. As a result, it is not uncommon for cutting teeth of core drilling bits to require time consuming replacement and repair either during or following a drilling operation. The cutting performance and efficiency of a bit could be increased if the bet could be kept in alignment. If the bit walks, the time to cut core specimen will be increased. Furthermore the operation of the conventional drilling apparatus requires that a worker remain within close proximity to the machine throughout the drilling process to apply downward thrust. Finally, when core drilling is completed, the entire apparatus must be disassembled and removed from the work area so that a separate lifting crane, as deployed for sawing operations, can be brought in to remove the core specimen. This lifting crane further consumes valuable resources as it requires an operator to man it in addition to the capital and transportation costs required to deploy it at the job site.

For the purposes of worker safety, it would also be preferred for a drilling apparatus not to require the operator to be so close to the rotating machinery and for the operator to not have to continually manually bias the loading device. To reduce operation costs, it would be desirable to create a core drilling apparatus that could avoid the costs associated with a supplemental lifting crane and reduce the size of the operation and support crew.

The present invention addresses the shortcomings of the prior art.

BRIEF SUMMARY OF THE INVENTION

The present invention overcomes the deficiencies of the prior art by presenting an apparatus and method for drilling and lifting core specimens efficiently with a single machine. The preferred embodiment of the present invention includes a frame structure that can be deployed to a workface and is adapted to hydraulically deploy a rotating core drilling bit upon that workface to cut a core specimen from the substrate. The hydraulic deployment of the drill bit is self aligning and does not require complex alignment steps to ensure the maximum cutting efficiency and lifetime of the bit.

The same apparatus that can be used to drive and deploy the drill bit can also be adapted to receive and lift the as-cut core specimen from the newly created hole in the substrate. Once lifted, the apparatus includes wheels so that it and the received specimen can be positioned out of the work area so that work within the newly created circular hole can progress. Furthermore, the same apparatus that is used to drill and pull core specimens can easily be adapted to lift and pull saw cut slab sections for more traditional, non circular shaped aggregate section removal. When equipped with an aggregate saw, the apparatus of the present invention is capable of performing a wide array of aggregate cutting and sawing tasks on a single platform, thus requiring operating crews to carry less equipment to the job site. Using the machine and methodology of the preferred embodiment of the present invention, a work crew can carry out core drilling tasks faster and more efficiently than previously possible.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1B:
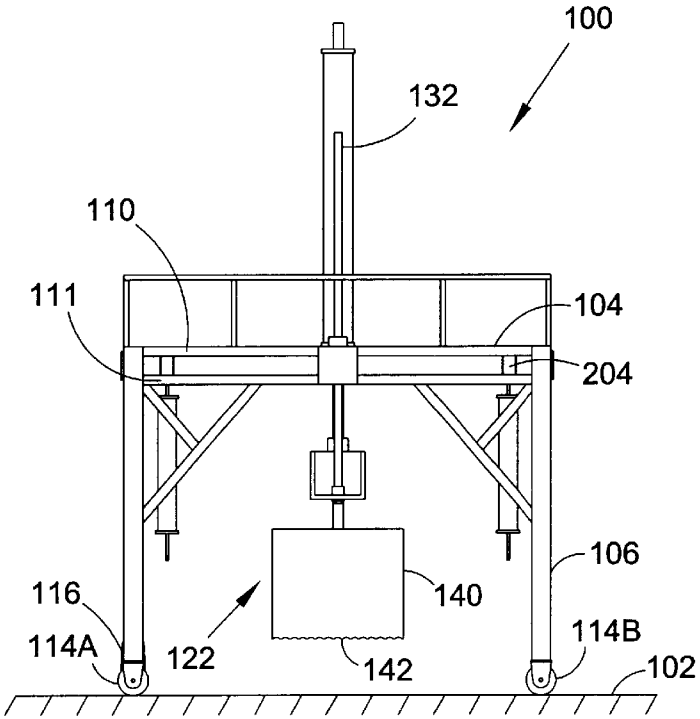
FIG. 1B is a side schematic view of the core drilling and lifting apparatus of FIG. 1A.
Figure 1A:
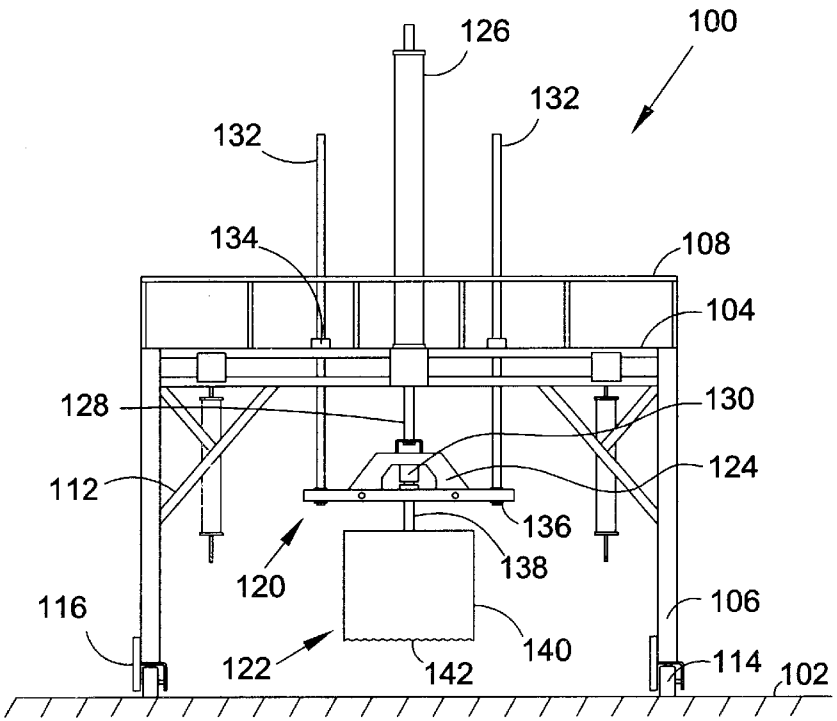
FIG. 1A is a front schematic view of a core drilling and lifting apparatus in accordance with a preferred embodiment of the present invention.

Referring now to FIGS. 1A–B, a drilling and pulling apparatus in accordance with a preferred embodiment of the present invention is shown. Apparatus 100 is preferably constructed as a structural frame that is deployed over a workface 102 from which a generally cylindrical hole is to be cut. Apparatus 100 includes a platform 104 supported by a plurality of legs 106 (preferably 4) and surrounded by guard rails 108. Platform 104 is constructed to withstand high loads in directions normal to workface 102 and is preferably manufactured as a welded steel frame with a plurality of braces 110,111 and cross members 112.

Legs 106 are welded to cross members 112 and braces 110 of platform 102 and preferably include wheels or casters 114 at their distal end. It is preferred that two adjacent legs 106 of a four legged apparatus 100 have mechanically driven wheels 114A, while the remaining two legs 106 include swivel casters 114B. On legs 106 that are mechanically driven, guards 116 may be included to cover the wheel 114 if desired to keep dirt and debris away from the drive components. By combining mechanically driven wheels 114A with swivel casters 114B, apparatus 100 can be positioned into a desired location upon a workface 102 accurately with minimal effort and maximum speed. Mechanically driven wheels 114A are preferably powered by an external hydraulic source (shown schematically as 144 in FIG. 2) although any suitable means of drive the wheels 114A is acceptable as well. Hydraulic power is preferred to drive wheels 114A as other components (as described below) preferably use hydraulics to function as a source of energy and a single hydraulic generator may be utilized to drive them at once.

Suspended underneath platform 104 is a drive assembly 120 adapted to rotate a drill bit 122. Drive assembly 120 includes a drive frame 124 and is preferably suspended from the underside of platform 104 by an axial positioning cylinder 126. Axial positioning cylinder 126 is mounted generally atop platform 104 and includes a load rod 128 that is allowed to pass through a bushing (not shown) and attach to the top of drive frame 124. Axial positioning cylinder 126 provides the upward and downward force required to drill and pull cores from the workface 102. Preferably, positioning cylinder 126 is hydraulically operated, but may be any other form of axial thruster including, but not limited to, pneumatic, ball screw, rack and pinion gear, and worm gear devices.

Housed within an opening of drive frame 124 is a drive motor 130. Drive motor 130 is used to provide the angular thrust from drive assembly 120 to drill bit 122. Drive motor 130 is preferably hydraulically driven but may be of any acceptable configuration including, but not limited to, electric, combustion engine, or pneumatic operation. Because an unsupported drive frame 124 is likely to rotate about load rod 128 of cylinder 126 when drive motor 130 is activated, two stabilization rods 132 are employed to counter this rotation. Stabilizer rods 132 are engaged through collars 134 atop platform 104 and are preferably secured to drive frame 124 by nuts 136. Although more stabilizer rods 132 may be employed, two (as shown) are generally sufficient to restrict any angular "twist" of drive frame 124 to an acceptable level.

Drill bit 122 is preferably a saw-type drill bit and is suspended from drive frame 124 by an extension 138 and connected to drive motor 130 at its top. Saw-type drill bit 122 is preferably constructed from a cylindrical barrel 140 with a plurality of teeth 142 brazed about the circumference at its bottom end. The composition, number, and spacing of teeth 142 is a function of the type of material and desired cutting rate of workface 102. Depending on material and desired rate of circumferential cut, different types, numbers, and spacing of cutter teeth 142 may be deployed about barrel 140 to maximize bit penetration speed and efficiency. Although apparatus 100 is shown employing a barrel-shaped saw bit 124 for drilling aggregate materials, it is to be understood that any other type of common drill may be employed, including but not limited to, twist bits, spade bits, masonry bits, and auger-type bits. In the circumstance whereby the material to be drilled is soil, gravel, or any other loose aggregate composition, an auger bit would be highly effective compared to a saw-type barrel bit shown in FIGS. 1A–B.

Figure 2:
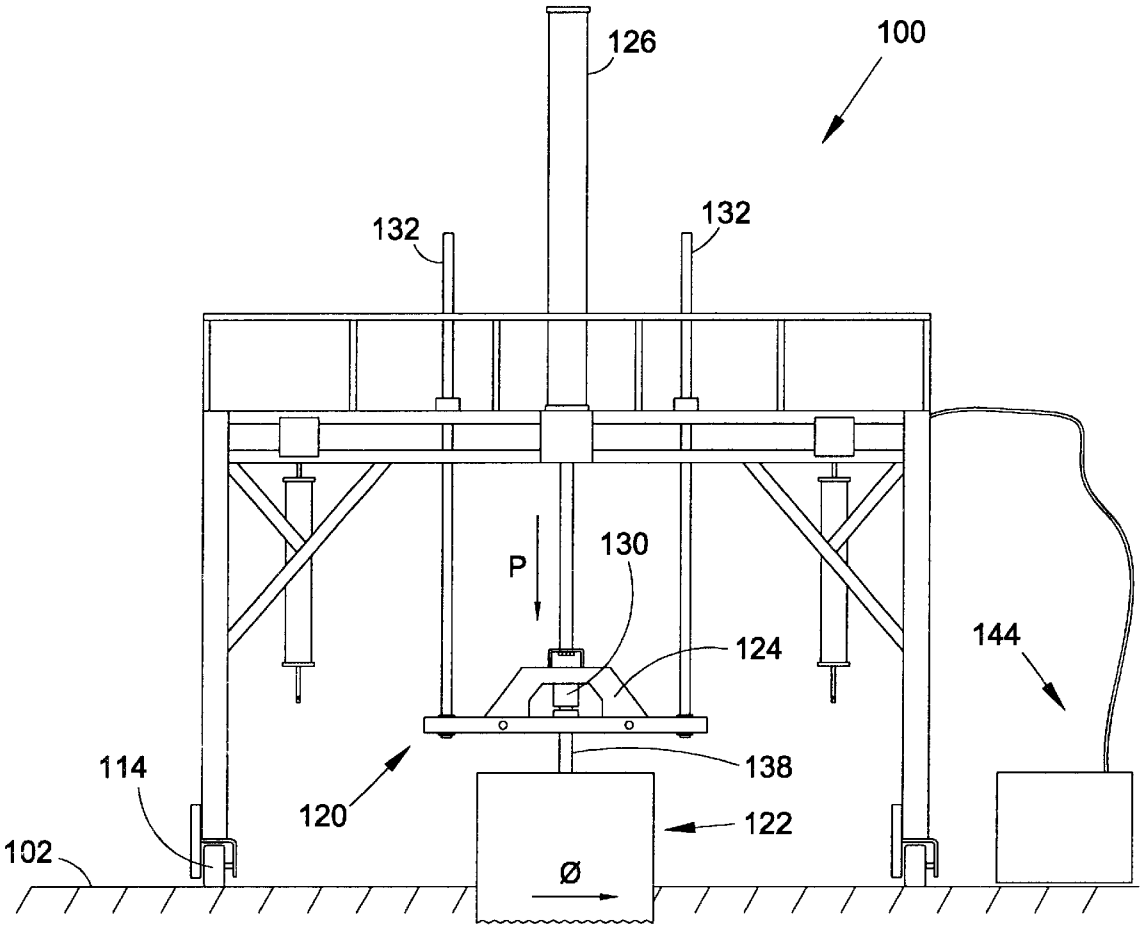
FIG. 2 is a schematic view of the core drilling and lifting apparatus of FIGS. 1A–B engaged in a drilling operation.

Referring now to FIG. 2, the operation of assembly 100 with drill bit 122 can be shown. To drill a core specimen, a hydraulic pump and distribution system 144 is attached to assembly 100 such that positioning cylinder 126, wheels 114A, and drive motor 130 all have access to the pressurized source. Using the distribution system controls to actuate and drive wheels 114A, apparatus 100 is positioned over workface 102 until the center axis of drill bit 122 is aligned with the desired center of the core specimen to be cut. Because apparatus 100 is supported by four equal-length legs 106, it is not necessary to manually level the apparatus as required by systems of the prior art. Once in alignment, wheels 114A and 114B are locked in position and drive motor 130 is activated. Once activated, drive motor 130 turns extension 138 and attached drill bit 122 in direction θ, preferably at a constant angular velocity. With bit 122 spinning in direction θ, axial cylinder 126 can be energized to drive the rotating bit 122 axially downward, in a direction P.

With bit 122 spinning and engaging workface 102, teeth 142 at distal end of bit barrel 140 saw workface 102 material as bit 122 is further engaged downward. Often, the engagement of workface 102 will resist and slow down the rotation of bit 122. To counter this resistance, operators can manipulate the hydraulic controls to increase the torque output of drive motor 130. To provide this extra torque, it may be preferred that motor 130 be driven from a separate, more powerful hydraulic pump and distribution system, than wheels 114A and cylinder 126. This arrangement would be advantageous because it allows cylinder 126 to continue to function properly in the event that motor 130 requires more power than expected. If bit motor 130 were to draw so much power that cylinder 126 were to become inoperable, damage to bit 122 could result. To assist in the cooling and lubrication of bit 122, an operator may spray a cutting fluid, preferably water, about the outer circumference of the bit barrel 140 with an ordinary garden hose (not shown). The fluid helps cool teeth 142 as well as carry cuttings away from the cutting surfaces.

Because cylinder 126 is used to apply load to rotating bit 122, the cutting forces can be distributed evenly across the cutting faces of bit 122. Maintaining uniform load upon bit 122 ensures maximum bit penetration rate into workface 102 and reduces wear on teeth 142 brazed about the circumference of bit barrel 140. Systems of the prior art currently available do not apply even loads through the axis of their respective bits. Instead, these assemblies typically apply cantilevered loads from one side to the rotating bit. As noted above, an operator is required to stand alongside the rotating bit and use manual methods to apply the downward thrust. Cantilevered loading, as applied by prior art core drilling apparatuses, generally do not apply even thrust loads across the cutting surfaces of their bits. This uneven thrust limits bit penetration rates and shortens bit life, thus requiring the cutting teeth to be replaced more frequently.

Figure 3:
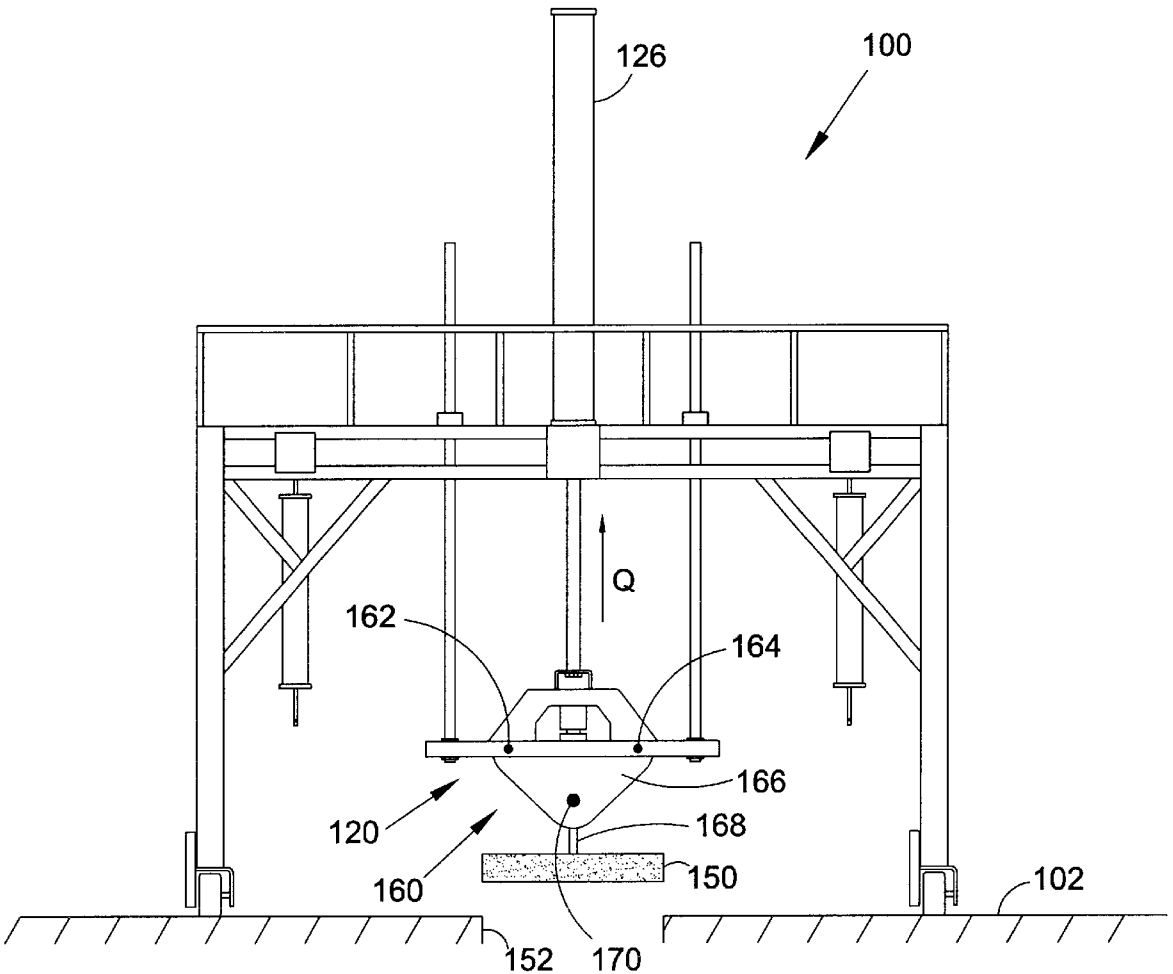
FIG. 3 is a schematic view of the core drilling and lifting apparatus of FIGS. 1A–B engaged in a lifting operation.

Referring now to FIG. 3, drilling apparatus 100 is shown in a lifting configuration removing a core specimen 150 from workface 102, thus exposing a hole 152. Following drilling (as shown in FIG. 2), drill bit 122 and attachment extension 138 are removed from drive assembly 120 and set aside. With drill bit 122 removed, cylinder 126 can be lowered allowing for the attachment of a pulling rig 160. Pulling rig 160 is attached to the underside of drive assembly 120 at locations 162 and 164 by engaging bolts or shear rods therethrough. Pulling rig 160 includes a load housing 166 and an anchor 168.

Anchor 168 can be of any type or configuration commonly available as longs as it is secure enough to support the entire weight of core specimen 150 but is preferably driven into the center axis of core specimen 150 by commonly available impact tools. Furthermore, anchor 168 is configured to be attached to housing 166 at 170 by a bolt or shear rod (not shown). With pulling rig 160 attached to core specimen 150 in this manner, positioning cylinder 126 can be retracted, thus lifting core specimen 150 out of hole 152 away from workface 102 in direction Q. Once core specimen 150 is clear of hole 152, drive wheels 114A of apparatus 100 can be actuated to move the core specimen 150 to a desired deposit location. Once in position, position cylinder 126 can then be extended again enabling core specimen 150 to be deposited out of the way of workface 102 and hole 152. The process can now be repeated, if necessary, by releasing pulling rig 160 and re-attaching bit 122 to drill another hole 152.

A considerable advantage of a preferred embodiment of the present invention is its ability to both cut and lift the core-drilled specimen. Systems of the prior art only function to cut the core specimen. Once cut, the drilling apparatus must be removed so that a lifting rig may be brought on site to lift the core specimen from the workface to expose the newly cut hole. This approach, although effective, is more time consuming and costly than that provided by the present invention. The preferred embodiment of the present invention provides a means to both cut and remove the core specimen with one piece of equipment and with minimal manpower.

Figure 4:
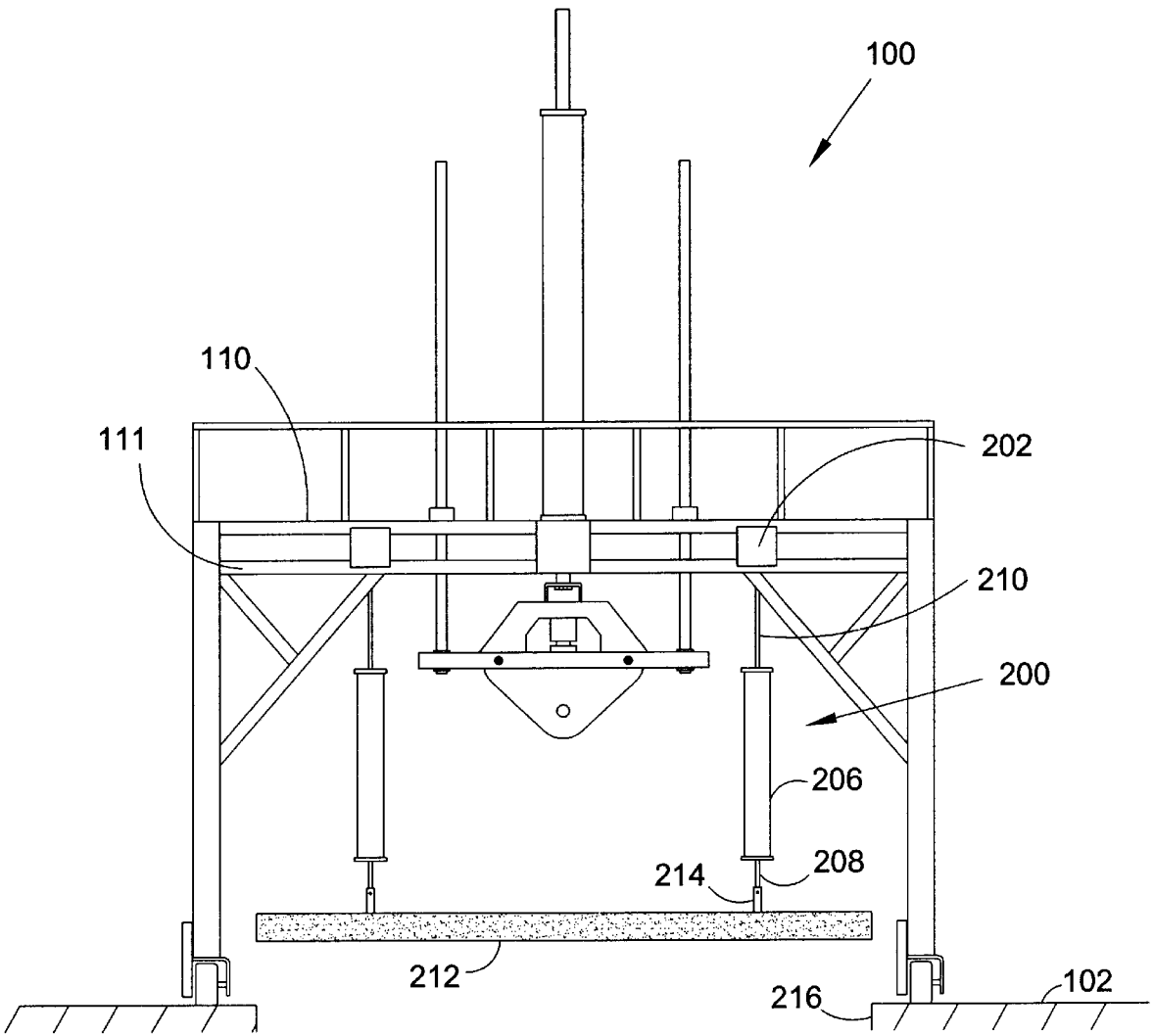
FIG. 4 is a schematic view of the core drilling and lifting apparatus of FIGS. 1A–B engaged in lifting a saw-cut aggregate section.

Because the apparatus 100 of a preferred embodiment of the present invention is desired to be deployed to a wide assortment of construction jobs, auxiliary equipment has been included to accommodate other types of work. Specifically, a slab lift system to lift large polygonal-shaped sections of aggregate material has been included upon platform 104 for convenience. Referring now to FIG. 4, slab lift system 200, includes movable horizontal support beams 202 located between braces 110 and 111 at each end of apparatus 100. Support beams 202 are slid into their preferred location atop beams 111 and include sliders 204 (shown in FIG. 1B) for supporting lift cylinders 206. Cylinders 206 are configured with anchor retainers 208 at their bottom most end and are secured to sliders 204 upon beams 202 by piston rods 210.

When a piece of cut aggregate material 212 is to be lifted out of place by system 200, apparatus 100 is moved into position as described above by driving wheels 114A and 114B. Anchors 214 are then set within the slab 212 and are connected to retainers 208 of cylinders 206. Cylinders 208 are moved into position by adjusting the locations of beams 202 and sliders 204 and are lined up with set anchors 214. Once in position, cylinders 206 are pressurized to lower retainers 208 so they may be attached to anchors 214. When anchors 214 are all properly attached, cylinders 206 are energized, thus lifting slab 212 out of workface 102 exposing a hole 216. With slab 212 lifted, wheels 114A and 114B of apparatus 100 can be driven to relocate and deposit removed slab 212 elsewhere. When work is completed within exposed hole 216, slab 212 can be returned and set back in place by reversing the steps above.

Advantages of the preferred embodiment of the present invention over systems of the prior art are numerous. Primarily, the present invention presents a system to accomplish both tasks of drilling and pulling cure specimens with a single machine. Furthermore, the device of the present invention is easily deployed and requires minimal setup time and resources. Because of its stability and even load distribution, the apparatus of the present invention is capable of drilling core specimens at a rate 2–3 times faster than conventional drilling systems. Additionally, because the system is preferably operated remotely by hydraulics, fewer operators are required and those that are required can maintain a safe distance from rotating equipment. Finally, an apparatus in accordance with the present invention offers the considerable advantage that a wide assortment of concrete cutting and lifting tasks can be performed by the same machine. In addition to drilling and pulling of core specimens, the apparatus is able to lift and deploy conventional equipment for sawing sections of concrete.

While a preferred embodiment of the invention has been shown and described, modifications thereof can be made by one skilled in the art without departing from the spirit of the invention.

What is claimed is:

1. An apparatus to lift a precut slab from a solid workface comprising:

a structural frame;

a horizontal support brace attached to the structural frame, said brace extending substantially parallel to the aggregate field from a first side of the structural frame to a second side of the structural frame;

a support slider coupled to and movable along the support brace;

an axial thruster supported by the support slider and configured to provide an axial lifting force in a direction substantially normal to the workface; and an anchor to be driven into the precut slab, said anchor coupled to the axial thruster to lift the core specimen out of the aggregate field, wherein the position of the axial thruster and anchor are adjustable by positioning the support slider along the horizontal support brace.

2. The apparatus of claim 1 further comprising a power transmission package supported from said structural frame, said power transmission package comprising a drive assembly configured to rotate a drill bit.

3. The apparatus of claim 2 wherein said axial thruster is a hydraulically actuated cylinder.

4. The apparatus of claim 3 wherein said structural frame comprises a plurality of legs, each of said legs including a wheel at a distal end.

5. The apparatus of claim 4 whereby at least one of said wheels is mechanically powered to assist in the positioning of said structural frame.

6. The apparatus of claim 5 wherein said powered wheel is hydraulically actuated.

7. An apparatus for cutting a generally cylindrically shaped core specimen from an aggregate field comprising:

a structural frame configured to support a load, the direction of said load being substantially normal to the aggregate field;

a power transmission package supported from said structural frame, said power transmission package comprising a drive assembly configured to rotate a drill bit, said drill bit having a center axis;

said power transmission package adapted to be raised and lowered with respect to the aggregate field by an axial thruster;

said axial thruster and said power transmission package configured to provide axial thrust generally through said center axis of said drill bit; and said drill bit configured to cut the core specimen from the aggregate field when rotationally engaged thereupon by said axial thruster;

wherein said structural frame comprises a plurality of legs, each of said legs including a wheel at a distal end and whereby at least one of said wheels is mechanically powered to assist in the positioning of said structural frame.

8. The apparatus of claim 7 wherein said powered wheel is hydraulically actuated.

9. The apparatus of claim 7 further comprising at least one stabilizer to prevent said power transportation package from rotating with respect to said structural frame.

10. An apparatus to cut and lift a generally cylindrically shaped core specimen from an aggregate field comprising:

a structural frame configured to support a large load, the direction of said load being substantially normal to the aggregate field;

a power transmission package supported from said structural frame, said power transmission package comprising a drive assembly configured to rotate a drill bit;

said power transmission package adapted to be raised and lowered with respect to the aggregate field by an axial thruster;

said drill bit configured to cut the core specimen from the aggregate field when rotationally engaged thereupon by said axial thruster; and an anchor to be driven into the core specimen, said anchor configured to be received within said power transmission package and lifted out of the aggregate field.

11. The apparatus of claim 10 wherein said axial thruster is hydraulically actuated.

12. The apparatus of claim 10 wherein said drive assembly is hydraulically actuated.

13. The apparatus of claim 10 wherein said structural frame comprises a plurality of legs, each of said legs including a wheel at a distal end.

14. The apparatus of claim 13 whereby at least one of said wheels is mechanically powered to assist in the positioning of said structural frame.

15. The apparatus of claim 14 wherein said powered wheel is hydraulically actuated.

16. The apparatus of claim 10 further comprising a plurality of hydraulic lift cylinders to lift an object from underneath said structural frame.

17. The apparatus of claim 10 further comprising at least one stabilizer to prevent said power transportation package from rotating with respect to said structural frame.

18. An apparatus for cutting a generally cylindrically shaped core specimen from an aggregate field comprising:

a structural frame configured to support a load, the direction of said load being substantially normal to the aggregate field;

a plurality of legs extending from said structural frame, each of said legs including a wheel at a distal end;

a power transmission package supported from said structural frame, said power transmission package comprising a drive assembly configured to rotate a drill bit;

said power transmission package adapted to be raised and lowered with respect to the aggregate field by a hydraulically actuated axial thruster;

at least one stabilizer to prevent said power transportation package from rotating with respect to said structural frame; and said drill bit configured to cut the core specimen from the aggregate field when rotationally engaged thereupon by said axial thruster.

19. A method for cutting and lifting a generally cylindrical-shaped specimen from a specified location within a solidified aggregate field, comprising:

locating a drilling frame over the specified location, said drilling frame comprising a support mechanism to withstand loads in a direction substantially normal to the aggregate field;

attaching a load device to the drilling frame, the load device configured to supply axial load in a direction substantially normal to the aggregate field;

rotating a barrel-shaped saw about the center axis of the desired cylindrical-shaped specimen whilst applying axial load from the load device to the barrel-shaped saw along the center axis and through the support mechanism; and securing an anchor to the cylindrical-shaped specimen, the anchor adaptable to be received within the support mechanism.

20. The method of claim 19 further comprising pulling the cylindrical shaped specimen from the aggregate field using the load device.

21. A method for cutting and lifting a generally cylindrical-shaped slab from a specified location within a solidified aggregate field, comprising:

positioning a drilling frame over the specified location;

attaching a load device to the drilling frame, the load device configured to supply axial load in a direction substantially normal to the aggregate field;

attaching a lifting device to a slider, said slider adapted to move along a support beam integrally attached to the drilling frame along a direction substantially parallel to the aggregate field;

cutting the slab by rotating a barrel-shaped saw about the center axis of the desired cylindrical-shaped specimen whilst applying axial load from the load device to the barrel-shaped saw along the center axis;

securing an anchor to the cut slab below the lifting device, the anchor adaptable to be attached to the lifting device;

attaching the anchor to the lifting device; and applying a lifting force to the anchor using the lifting device.

22. The method of claim 21 further comprising positioning the lifting device by moving the slider along the support beam.

23. The method of claim 22 further comprising pulling the cylindrical-shaped slab from the aggregate field using the lifting device.

24. The method of claim 23 further comprising moving the cylindrical-shaped slab away from the specified location by positioning the drilling frame in a remote location.

25. The method of claim 24 further comprising positioning the drilling frame using a set of mechanically-driven wheels attached beneath the drilling frame.

26. The method of claim 25 further comprising hydraulically actuating the load device, the lifting device, and the mechanically-driven wheels.

* * * * *